United States Patent [19]

Redemske et al.

[11] Patent Number: 4,961,455

[45] Date of Patent: Oct. 9, 1990

[54] COUNTERGRAVITY CASING APPARATUS AND METHOD WITH MAGNETICALLY ACTUATED VALVE TO PREVENT MOLTEN METAL RUN-OUT

[75] Inventors: John A. Redemske, Mont Vernon, N.H.; Merton C. Flemings, Cambridge, Mass.

[73] Assignee: Hitchiner Manufacturing Co., Inc., Milford, N.H.

[21] Appl. No.: 376,133

[22] Filed: Jul. 6, 1989

[51] Int. Cl.[5] ..... B22D 18/06; B22D 27/02

[52] U.S. Cl. ..... 164/63; 164/255; 164/147.1; 164/337; 222/504

[58] Field of Search ..... 164/119, 255, 133, 63, 164/147.1, 146, 337; 222/504

[56] References Cited

U.S. PATENT DOCUMENTS

| | | | |
|---|---|---|---|
| 2,243,293 | 5/1941 | Stahl | 22/68 |
| 2,991,518 | 7/1961 | Schaefer | 22/73 |
| 3,032,841 | 5/1962 | Sylvester | 22/69 |
| 3,090,090 | 5/1963 | Woodburn, Jr. | 22/84 |
| 3,443,629 | 5/1969 | Ebeling | 164/339 |
| 3,529,657 | 9/1970 | Bucy | 164/257 |
| 3,532,154 | 10/1970 | Balevski | 164/119 |
| 3,774,668 | 11/1973 | Iten et al. | 164/255 |
| 3,905,419 | 9/1975 | Tenner | 164/337 |
| 4,340,108 | 7/1982 | Chandley et al. | 164/63 |
| 4,589,466 | 5/1986 | Chandler et al. | 164/119 |
| 4,862,945 | 9/1989 | Greanias et al. | 164/63 |

FOREIGN PATENT DOCUMENTS

| | | | |
|---|---|---|---|
| 6502829 | 9/1965 | Netherlands . | |
| 7002655 | 8/1970 | Netherlands . | |
| 1042881 | 9/1983 | U.S.S.R. . | |
| 1028736 | 5/1966 | United Kingdom | 164/119 |
| 1169996 | 11/1969 | United Kingdom | 222/504 |

*Primary Examiner*—Kuang Y. Lin

*Attorney, Agent, or Firm*—Reising, Ethington, Barnard, Perry & Milton

[57] ABSTRACT

The casting apparatus and method include a magnetically responsive valve disposed in the molten metal inlet passage of the mold for movement between an open position during mold filling and a closed position after mold filling and during removal of the mold from the underlying molten metal pool to prevent run-out of molten metal from the metal-filled mold cavity. The valve is moved to the closed position by a magnetic force exerted thereon by permanent magnets or an electromagnet disposed around the inlet passage below the valve.

29 Claims, 2 Drawing Sheets

COUNTERGRAVITY CASING APPARATUS AND METHOD WITH MAGNETICALLY ACTUATED VALVE TO PREVENT MOLTEN METAL RUN-OUT

FIELD OF THE INVENTION

The invention relates to a differential pressure, countergravity casting apparatus and method and, more particularly, to a magnetically actuated valve incorporated into an inlet passage of a countergravity casting mold to prevent flow of molten metal out of the casting mold when it is withdrawn from an underlying molten metal pool after filling with molten metal.

BACKGROUND OF THE INVENTION

The Chandley et al U.S. Pat. No. 4,589,466 issued May 20, 1986, illustrates the differential pressure, countergravity casting of molten metal wherein a gas permeable mold includes a crimpable metal fill tube sealingly connected to the lower end of a riser passage and adapted for immersion in an underlying molten metal pool during casting to fill a plurality of mold cavities in the mold. Once the mold cavities are filled with the molten metal by countergravity casting from the underlying melt, the metal fill tube is crimped closed while immersed in the molten metal pool to prevent molten metal run-out upon subsequent removal of the fill pipe from the molten metal pool. Molten metal remains and solidifies in the fill pipe above the crimped portion thereof as well as in the mold cavities, the intermediate riser passage and the ingates to each mold cavity. In the casting of higher melting point metals, the use of a crimpable metal fill pipe provides an unsatisfactory degree of reliability since the hot metal can occasionally melt through the fill pipe even when it is coated with a ceramic wash or layer. As a result, use of a metal fill pipe limits the type of metal that can be countergravity cast to those that will not melt through the fill pipe during the time that the metal remains molten therein. Moreover, crimping of the fill pipe is effected using a fluid cylinder driven crimping member and abutment which complicate operation of the casting apparatus. In addition, the crimped fill pipe is not reusable and must be discarded after use, increasing the cost of the casting process.

It is an object of the invention to provide an improved, economical, differential pressure, countergravity casting apparatus and method using a magnetically actuated valve means associated with the casting mold to prevent molten metal run-out from the mold when it is withdrawn from the underlying molten metal pool after filling the mold with molten metal.

It is another object of the invention to provide an improved, economical, differential pressure, countergravity casting apparatus and method using such a magnetically actuated valve means that permits the casting of higher melt point metals.

It is another object of the invention to provide an improved, economical, differential pressure, countergravity casting apparatus and method using such a magnetically actuated valve means that facilitates removal of pattern material, such as wax, from the mold prior to casting and facilitates filling of the mold with molten metal during casting.

SUMMARY OF THE INVENTION

The invention contemplates a differential pressure, countergravity casting apparatus including a mold having a mold cavity for receiving the molten metal and an inlet passage means with a lower open end for admitting the molten metal into the mold cavity from an underlying molten metal pool. A magnetically responsive valve means is disposed in the inlet passage means for movement between an open position for admitting the molten metal into the mold when the lower open end is immersed in the molten metal pool with a negative differential pressure established to draw the molten metal upwardly into the mold cavity through the inlet passage means and a closed position for preventing molten metal flow or run-out from the mold cavity after it is filled with the molten metal. Magnetic force generating means is provided for subjecting the valve means to a magnetic force to move the valve means to the closed position to prevent run-out of the molten metal from the metal-filled mold cavity when the lower open end is removed from the molten mold pool.

In one embodiment of the invention, the means for subjecting the valve means to a magnetic force comprises one or more permanent magnets disposed around the inlet passage means below the valve means.

In another embodiment of the invention, the means for subjecting the valve means to a magnetic force comprises an electromagnet disposed around the inlet passage means below the valve means.

Preferably, the means for subjecting the valve means to a magnetic force is disposed below the valve means exteriorly of the mold around a depending fill pipe or ingate that defines the inlet passage means of the mold.

The valve means preferably comprises a magnetically susceptible ball valve movable between the closed position and open position relative to a valve seat disposed in the inlet passage means.

The invention also contemplates a method of countergravity casting including (a) providing a mold having a mold cavity and a molten metal inlet passage means with a lower open end adapted for immersion in an underlying molten metal pool, (b) relatively moving the mold and the pool to immerse the lower open end in the pool, (c) applying a differential pressure between the mold cavity and the pool to urge the molten metal upwardly through the inlet passage means into the mold cavity thereabove to fill the mold cavity with the molten metal, including opening a magnetically responsive valve means disposed in the inlet passage means as the molten metal is urged upwardly therethrough, (d) applying a magnetic force to the open valve means to move the valve means to a closed position where the valve means prevents flow or run-out of the molten metal from the metal-filled mold cavity, and (e) relatively moving the mold and the pool to remove the open lower end of the inlet passage means from the pool with the valve means in the closed position, preferably held magnetically in the closed condition.

Other features and advantages of the invention will be apparent from the following detailed description taken with the following drawings.

DETAILED DESCRIPTION OF THE INVENTION

Figure 1:
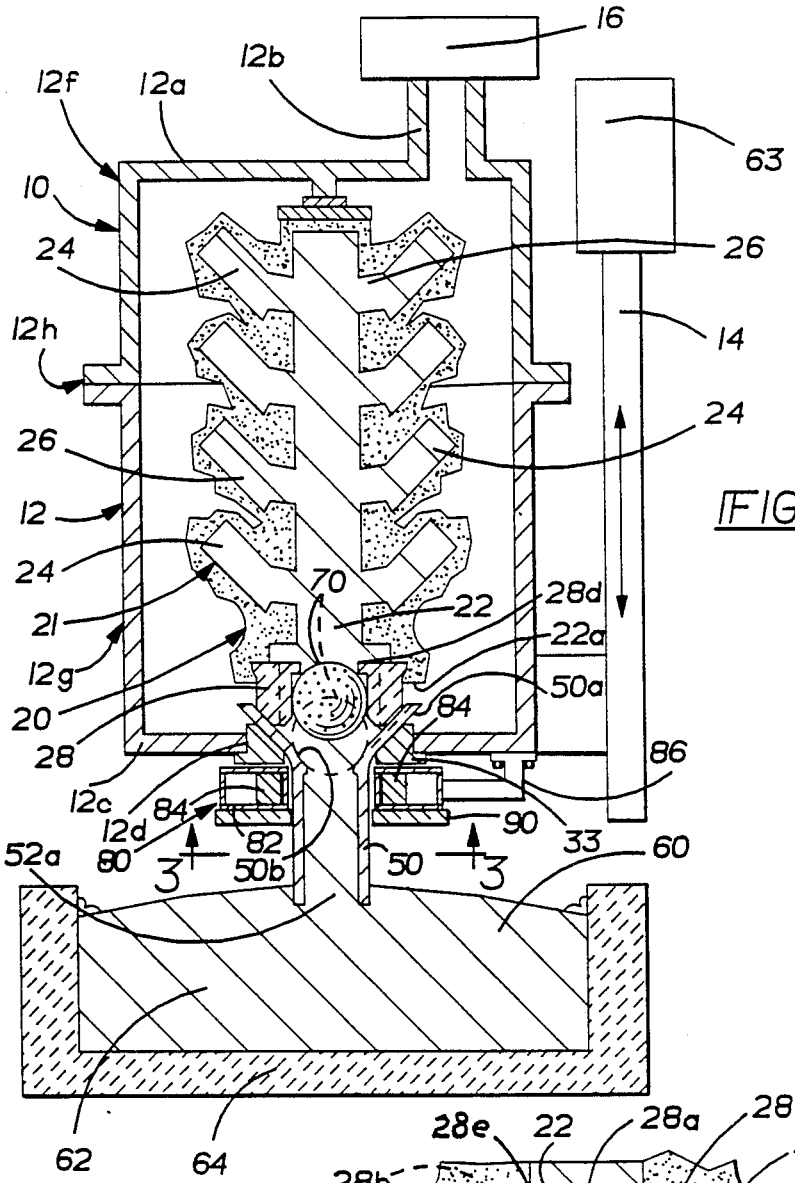
FIG. 1 is a schematic sectioned elevational view of a differential pressure, countergravity casting apparatus according to the invention for practicing the method of the invention.
Figure 2:
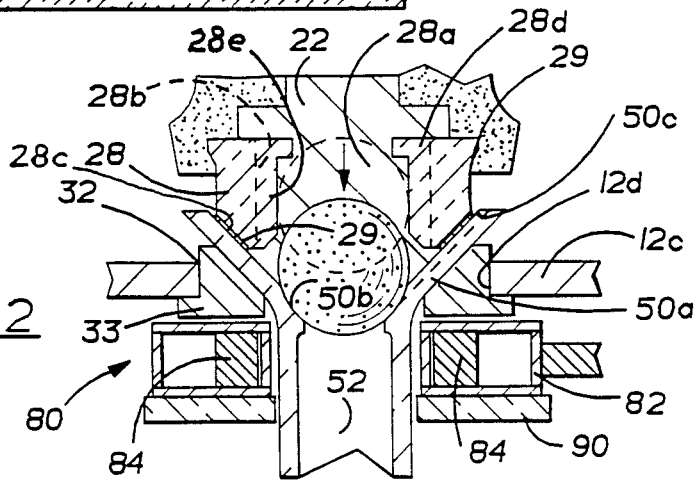
FIG. 2 is an enlarged, partial sectioned elevational view of the magnetically actuated valve means.
Figure 3:
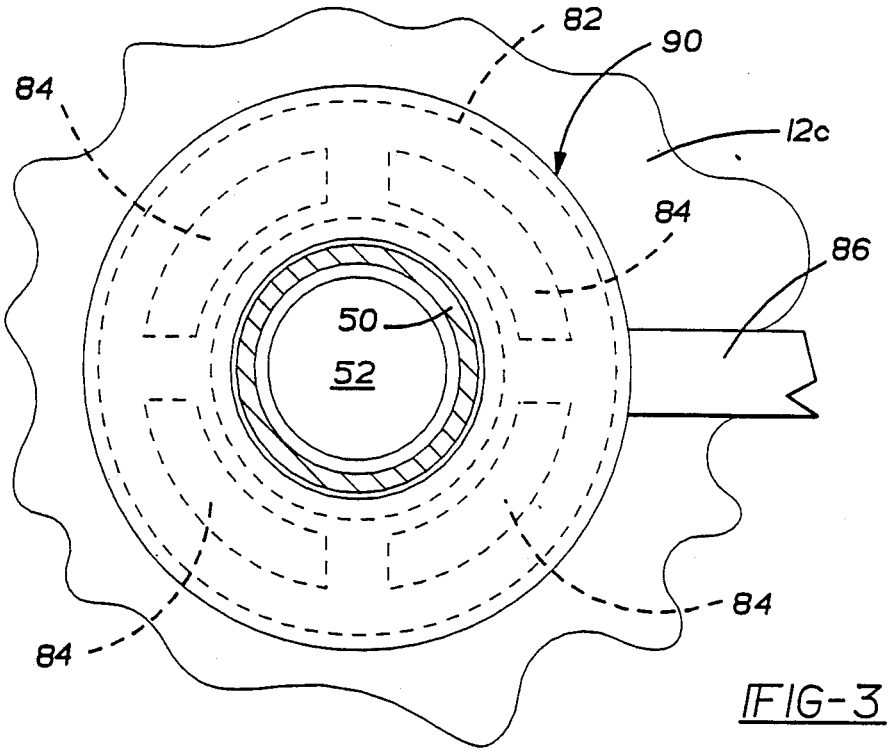
FIG. 3 is a partial view of the casting apparatus taken in the direction of lines 3—3 of FIG. 1.

Referring to FIGS. 1–3, there is provided a casting apparatus 10 including a two-part casting chamber 12 mounted on a vertically movable support arm 14. The casting chamber 12 includes an upper wall **12*a* having a conduit 12*b* communicated to a differential pressure apparatus 16, e.g., a vacuum pump, and a lower, mold supporting wall 12*c* for supporting a porous, gas permeable mold 20, which is shown as a ceramic investment shell mold, although the invention is not so limited. The gas permeable mold 20 includes a main mold cavity 21 having a longitudinal, vertical riser passage 22 communicating with a plurality of article-shaped mold cavities 24 thereabove via respective lateral ingate passages 26. The article-shaped mold cavities 24** are configured in the shape of the articles to be cast.

The gas permeable mold 20 includes an annular, ceramic collar 28 captured in the open lower end of the mold. The ceramic mold collar 28 extends below the mold bottom **22*a* toward a central opening 12*d* in lower, mold-supporting wall 12*c* of the casting chamber 12. The mold collar 28 includes a central passage 28*a* (FIG. 2) with circumferentially spaced apart molten metal inlet slots or passages 28*b* cooperating with the vertical riser passage 22 and ingate passages 26 to supply molten metal to the mold cavities 24. The inlet slots or passages 28*b* are separated by circumferentially spaced apart ribs 28*e* of the mold collar 28. The mold collar 28 can be formed as part of the mold 20** itself.

The mold 20 also includes an elongate ceramic mold fill pipe 50 that defines a longitudinal molten metal inlet passage 52 having a lower open end **52*a*. The mold fill pipe 50 includes a diverging, frusto-conical upper end 50*a* sealingly attached to the mold collar 28 by a conformable seal 29; e.g., a core paste (resin and ceramic flour mixture) seal disposed between the mating frusto-conical surfaces 28*c* and 50*c* of the collar and the fill pipe, respectively. As shown best in FIG. 1, the elongate ceramic fill pipe 50 depends from the mold collar 28 toward an underlying molten metal pool 60 formed of molten metal 62 held in a crucible or other container 64**.

As shown in FIG. 1, a magnetically responsive or susceptible valve means 70 in the form of a ceramic coated, magnetically susceptible ball valve is disposed in the mold collar 28 for movement between an open position (shown in solid lines in FIG. 1) and a lower closed position (shown in phantom lines in FIG. 1). The ball valve preferably comprises a mild steel ball with a highly insulating, porous ceramic coating (e.g., $ZrO_2$) formed thereon by the reaction of an acidic ceramic slurry with the surface of the steel ball. The open position of the ball valve 70 is limited by upper shoulders **28*d* on the ribs 28*e* of the mold collar 28. The areas of contact between the shoulders 28*d* and the valve 70 are minimized to prevent freezing metal from holding the valve 70 in the upper (open) position. As will be explained below, the ball valve 70 moves to the open position abutted against the shoulders 28*d* as molten metal flows upwardly in the inlet passage 52 to fill the mold cavities 24. The closed position of the ball valve 70 is defined by an annular valve seat 50*b* formed in the inlet passage 52 of the fill pipe 50** as shown.

The upper frusto-conical end **50*a* of the ceramic fill pipe 50 is sealingly received in the bottom wall 12*c* of the chamber 12 by virtue of sealingly engaging an annular, non-magnetic, stainless steel seal insert 33 disposed therebetween. A fiber refractory sealing gasket (not shown) is typically disposed between the upper end 50*a* and the seal insert 33**.

Encircling the mold fill pipe 50 below the valve seat **50*b* and the ball valve 70 is a magnet assembly 80 comprising an annular, non-magnetic stainless steel housing 82 and a plurality (4) of permanent rare earth magnets 84 disposed in the housing 82. As shown best in FIG. 3, the magnets 84 in the housing 82 are arranged circumferentially about the fill pipe 50 in such a manner as to exert a downward magnetic force on the ball valve 70 toward the valve seat 50*b* as will be explained hereinbelow. The housing 82 is supported on support handle 86 that is releasably attached to the bottom walls 12*c* of the casting chamber, FIG. 1, such that the magnet assembly 80 moves in unison with the casting chamber 12 during movement toward the pool 62 to immerse the lower open end 52*a* of the fill pipe 50 in the pool. The magnet assembly 80 is shielded from the heat of the pool 62 by the annular ceramic fiber insulation/radiation shield 90 disposed between the magnet assembly 80 and the pool 62. Typically, the shield 90 is attached to and carried on the bottom of the housing 82 of the magnet assembly 80**.

The casting chamber 12 with the mold 20 supported therein is lowered on the support arm 14 toward the molten metal pool 60 to immerse the lower open end **52*a* of the ceramic fill pipe 50 in the molten metal 62, FIG. 1. The support arm 14 is lowered by a suitable actuator 63 such as a hydraulic pneumatic, electrical or other actuator. After the fill pipe 50 is immersed in the molten metal, a vacuum is drawn in the casting chamber 12 by differential pressure apparatus 16 (vacuum pump) through the conduit 12*b*. The vacuum can be drawn in chamber 12 prior to immersion of the fill pipe 50 in the pool 60, if desired, as well as afterward. Drawing of the vacuum in the casting chamber 12 evacuates the mold cavities 24 through the porous, gas permeable mold 20 and applies a differential pressure between the mold 20 and the molten metal pool 60 to cause the molten metal 62 to flow upwardly through the fill pipe 50, the riser passage 22, and the lateral ingate passages 26 to fill the mold cavities 24** with the molten metal.

During filling of the mold cavities 24 in this manner, the molten metal drawn upwardly in the fill pipe 52 pushes the ball valve 70 upwardly to abut the shoulder **28*d* of the collar 28, thereby moving the ball valve 70 to the open position in opposition to the magnetic force applied on the ball valve 70 by the magnets 84. As soon as the upward flow of the molten metal ceases after the mold cavities 24 are filled, the magnetic force applied by the magnets 84 causes the magnetically susceptible ball valve 70 to move downwardly to the lower closed position sealed against the valve seat 50*b*. In this closed position, the ball valve 70 prevents molten metal thereabove from running out of the riser passage 22, mold cavities 24 and lateral passages 26 thereabove when the lower open end 52*a* of the fill pipe 50 is subsequently removed from the pool 62. The magnetic force exerted by the magnets 84 on the ball valve 70 is selected to insure positive seating thereof on valve seat 50*b* for molten metal sealing purposes during such withdrawal of the lower open end 52*a* out of the pool. For example, a magnetic force of 300 grams has been used to seat a zirconia coated mild steel ball valve 70 weighing 254 grams on the valve seat 50***b* after casting molten steel into a mold 20. Once the ball valve 70 moves to the closed position, the vacuum in the chamber 12 can be discontinued and ambient pressure provided in the chamber 12. Thereafter, the support arm 14 is raised by the actuator 63 to raise the casting chamber 12 and molten metal-filled mold 20 supported thereon a sufficient distance away from the molten metal pool 60 to withdraw the open lower end 52*a* of the fill pipe 50 from the molten metal 12. Upon withdrawal of the fill pipe 50 from the molten metal pool 60, the ball valve 70 seated against the valve seat 50*b* by the magnets 84 prevents gravity-induced back-flow or run-out of the molten metal thereabove in the mold 20 while the molten metal therebelow in the fill pipe 50 drains back into the pool 62.

Following release of the vacuum in the casting chamber 12 and withdrawal of the fill pipe 50 from the pool 62, the metal-filled mold 20 and the fill pipe 50 can be removed from the casting chamber 12 such that the casting chamber can be used in casting the next successive mold 20. The metal-filled mold 20 and the fill pipe 50 are removed from the casting chamber 12 by removing the upper portion 12*f* of the chamber from sealing engagement with the lower portion 12*g* at flange 12*h* and then lifting the metal-filled mold 20 and fill pipe 50 out of the lower portion 12*g*. The metal-filled mold 20 can be set in a sand bed or on another support to allow the molten metal to solidify therein under ambient pressure. The magnet assembly 80 may then be removed from the bottom wall 12*c* of the casting chamber 12 to permit cooling of the permanent magnets 84 so that they retain their magnetic field strength.

Figure 4:
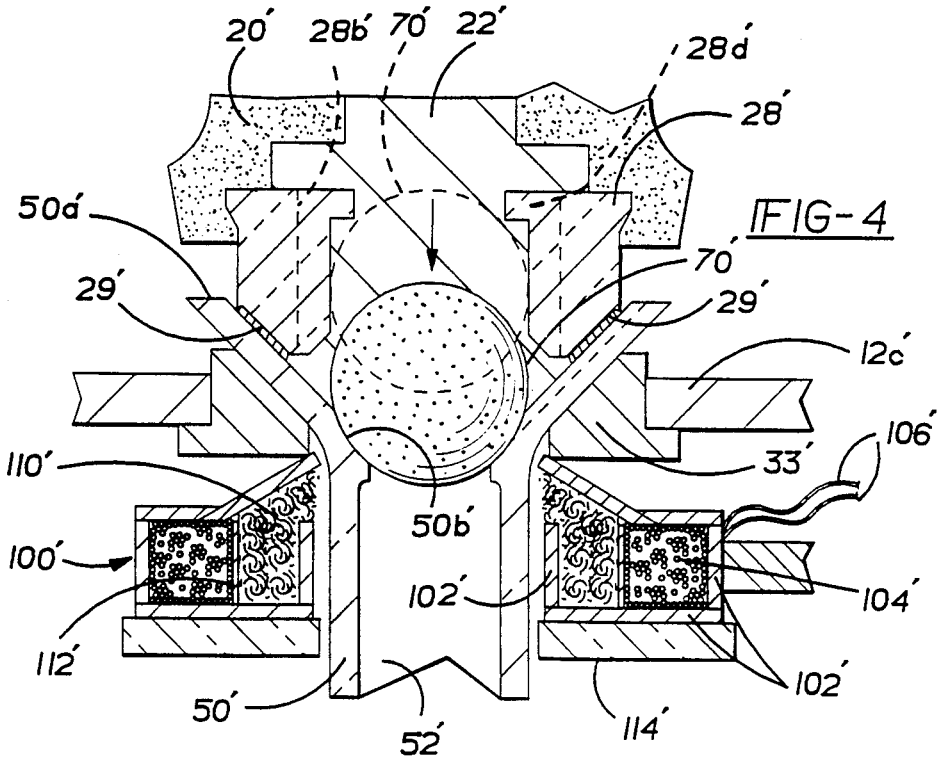
FIG. 4 is an enlarged, partial sectioned elevational view of another embodiment of the casting apparatus of the invention.

FIG. 4 illustrates another embodiment of the invention wherein like features of FIGS. 1–3 are represented by like reference numerals primed. The embodiment of FIG. 4 differs from that of FIGS. 1–3 in having an electromagnet assembly 100' substituted for the permanent magnet assembly 80 of FIGS. 1–3. The electromagnet assembly 100' includes a magnetically permeable steel housing 102' and an annular wire coil 104' (e.g., a 100 turn coil) disposed in the housing 102'. The coil 104' includes electrical power leads 106' for connection to a suitable source of electrical power (not shown) to energize the coil 104'. The coil 104' is shielded from the heat of the molten metal in fill pipe 50' by ceramic fiber insulation 110' and a steel partition 112' in the housing 102'. A ceramic fiber insulation/radiation shield 114' is attached on the bottom side of the housing 102' to protect it from the heat of the pool 62 therebelow.

In the embodiment of FIG. 4, the coil 104' is not energized during countergravity filling of the mold 20' with the molten metal 62' when the fill pipe 50' is immersed in the pool 62' and the chamber 12' is evacuated. As molten metal rises in the fill pipe 50', the ball valve 70' is pushed to the open position shown in phantom in FIG. 4. However, once the mold cavities (not shown) are filled with the molten metal, the coil 104' is energized to subject the magnetically responsive ball valve 70' to a sufficient magnetic force to move the ball valve 70' to the closed position shown in solid in FIG. 4 positively engaged against the valve seat 50*b'*. The degree of downward force exerted on the ball valve 70' can be varied by varying the electrical power supplied to the coil 104' of the electromagnet assembly 100'.

In the embodiments of FIGS. 1–4, the cross-sectional sectional flow area of the slots 28*b*(28*b'*) in the collar 28(28') and the passage 52(52') of the fill pipe 50(50') can be selected to provide rapid filling of the mold cavities 24 with the molten metal and to also facilitate removal of pattern material, such as wax, from the mold 20 (20') prior to casting molten metal therein.

Use of the ceramic fill pipe 50(50') and ceramic coated ball valve 70(70') permits the casting of higher melting point metals than possible with the crimpable metal fill tube of U.S. Pat. No. 4,589,466 referred to hereinabove.

In addition, use of the magnetically responsive valve 70(70') in conjunction with the magnet assembly 80(100') provides an operationally simpler technique for preventing run-out of molten metal from the mold than provided by the crimpable metal fill pipe and auxiliary crimping equipment of U.S. Pat. No. 4,589,466.

Although the invention has been illustrated for use with the investment shell mold 20, those skilled in the art will appreciate that the invention is not so limited and can be used with other types of countergravity casting molds, such as bonded sand molds, unbonded sand molds and others, to prevent molten metal run-out when the molten metal inlet passage of the mold is withdrawn from an underlying molten metal pool after the mold cavities are filled with molten metal. Those skilled in the art will appreciate that the molten metal inlet passage 52 can be defined by a fill pipe (e.g., 50) of the type shown in FIGS. 1–4. Alternatively, the molten metal inlet passage (ingate) can be formed internal and integral of the mold itself so as to communicate a mold cavity therein with a bottom side of the mold that is adapted for immersion in the underlying molten metal pool, for example, as shown in U.S. Pat. Nos. 4,340,108 and 4,606,396.

While the invention has been described in terms of specific embodiments thereof, it is not intended to b limited thereto but rather only to the extent set forth hereafter in the following claims.

We claim:

1. Apparatus for countergravity casting of molten metal, comprising:

(a) a mold having a mold cavity for receiving the molten metal and molten metal inlet passage means for supplying the molten metal to the mold cavity, said inlet passage means including a lower open end adapted for immersion in an underlying molten metal pool, (b) magnetically responsive valve means disposed in the inlet passage means for movement between an upper open position for permitting the molten metal to flow thereby to the mold cavity when said lower open end is immersed in said molten metal pool with a negative differential pressure established to draw the molten metal upwardly through said inlet passage means and a lower closed position for preventing molten metal flow from the mold cavity after it is filled with molten metal, and (c) means for subjecting the valve means to a magnetic force after the mold cavity is filled with the molten metal to move the valve means to the closed position to prevent flow of the molten metal from the metal-filled mold cavity when said lower open end is removed from said pool.

2. The apparatus of claim 1 wherein the valve means includes a valve body of magnetically susceptible material.

3. The apparatus of claim 2 wherein the valve body comprises an iron-based material having a protective ceramic coating thereon.

4. The apparatus of claim 2 wherein the valve body comprises a steel ball valve with a zirconia coating thereon.

5. The apparatus of claim 2 wherein the valve body comprises a steel ball valve with an insulating, porous ceramic coating thereon produced by the reaction of an acidic ceramic slurry with the surface of the steel ball valve.

6. The apparatus of claim 1 wherein a valve seat is disposed in said inlet passage means for sealing engagement by said valve means when it is in the closed position.

7. The apparatus of claim 6 wherein a stop means is disposed above the valve seat in said inlet passage means for limiting upward movement of the valve means in the open position while permitting molten metal flow thereby to the mold cavity.

8. The apparatus of claim 7 wherein the stop means comprises circumferentially spaced apart stop shoulders that are contacted by the valve means in the open position, the contact area between the stop shoulders and the valve means when the valve means is in the open position being so selected as to prevent solidifying metal from holding the valve means in the upper open position.

9. The apparatus of claim 1 wherein said means for subjecting the valve means to a magnetic force is disposed around the inlet passage means.

10. The apparatus of claim 9 wherein said means for subjecting the valve means to a magnetic force is disposed below said valve means.

11. The apparatus of claim 10 wherein said means for subjecting the valve means to a magnetic force is disposed exteriorly of the mold.

12. The apparatus of claim 11 wherein said means for subjecting the valve means to a magnetic force is disposed around a fill pipe depending from said mold.

13. The apparatus of claim 12 wherein thermal insulating means is disposed between said means and the underlying molten metal pool.

14. The apparatus of claim 12 wherein thermal insulating means is disposed between said fill pipe and said means for subjecting the valve means to a magnetic force.

15. The apparatus of claim 1 wherein said means for subjecting the valve means to a magnetic force comprises permanent magnet means.

16. The apparatus of claim 1 wherein said means for subjecting the valve means to a magnetic force comprises electromagnet means.

17. A method of countergravity casting molten metal, comprising:

(a) providing a mold having a mold cavity and a molten metal inlet passage means with a lower open end adapted for immersion in an underlying molten metal pool, (b) relatively moving the mold and the pool to immerse said lower open end in the pool, (c) applying a differential pressure between the mold cavity and the pool to urge the molten metal upwardly through the inlet passage means into the mold cavity thereabove to fill the mold cavity with the molten metal, including opening a magnetically responsive valve means disposed in the inlet passage means to an upper open position to permit the molten metal to flow thereby to the mold cavity as the molten metal is urged upwardly through the inlet passage means, (d) applying a magnetic force to the open valve means after the mold cavity is filled with the molten metal to move said valve means to a lower closed position where said valve means prevents flow of molten metal from the metal-filled mold cavity, and (e) relatively moving the mold and the pool to remove said open lower end from the pool with said valve means being in the closed position.

18. The method of claim 17 wherein step (c), the valve means is opened by said molten metal flowing upwardly in the inlet means.

19. The method of claim 18 wherein the valve means is opened by said molten metal overcoming a magnetic force applied to the valve means during filling of the mold cavity with the molten metal.

20. The method of claim 19 wherein the valve means is closed in step (d) by said magnetic force as upward molten metal flow ceases.

21. The method of claim 20 wherein said magnetic force is applied by permanent magnet means cooperatively disposed relative to the valve means.

22. The method of claim 21 including disposing the permanent magnet means around said inlet passage means below the valve means and a valve seat in said inlet passage means.

23. The method of claim 17 wherein in step (d), the magnetic force is applied by energizing an electromagnet means cooperatively disposed relative to the valve means.

24. The method of claim 23 including disposing the electromagnet means around the inlet passage means below the valve means and a valve seat disposed in the inlet passage means.

25. The method of claim 17 wherein the valve means is held magnetically in the closed position when the lower open end is removed from the pool.

26. The method of claim 18 including limiting upward movement of the valve means using a stop means that is disposed in the inlet passage means above the valve means and allows molten metal flow thereby to the mold cavity when the valve means is in the upper open position.

27. The method of claim 26 including so minimizing the contact area between the stop means and the valve means as to prevent solidifying metal from holding the valve means in an upper, open position.

28. Apparatus for countergravity casting of molten metal, comprising:

(a) a mold having a mold cavity for receiving the molten metal, an upstanding riser passage communicated to the mold cavity for supplying molten metal thereto, and a fill pipe disposed below the riser passage and having a fill pipe upper end communicated to the riser passage and a fill pipe lower open end adapted for immersion in an underlying molten metal pool, (b) magnetically responsive valve means disposed between the riser passage and the fill pipe for movement to an upper open position for permitting the molten metal to flow thereby into the riser passage and the mold cavity when said fill pipe lower open end is immersed in said molten metal pool with a negative differential pressure established to draw the molten metal upwardly through said fill pipe and to a lower closed position for preventing molten metal flow from the riser passage and the mold cavity after the mold cavity is filled with the molten metal, and (c) means disposed about the fill pipe below said valve means for subjecting the valve means to a magnetic force to move the valve means to the closed position to prevent flow of the molten metal from the metal-filled riser and mold cavity when said fill pipe lower open end is removed from said pool while permitting the molten metal to drain from the fill pipe.

29. A method of countergravity casting molten metal, comprising:

(a) providing a mold having a mold cavity, an upstanding riser passage communicated to the mold cavity for supplying the molten metal thereto, and a fill pipe disposed below the riser passage and having a fill pipe upper end communicated to the riser passage and a fill pipe lower open end adapted for immersion in an underlying molten metal pool, (b) relatively moving the mold and the pool to immerse said fill pipe lower open end in the pool, (c) applying a differential pressure between the mold cavity and the pool to urge the molten metal upwardly through the fill pipe and riser passage into the mold cavity to fill the mold cavity with the molten metal, including opening a magnetically responsive valve means disposed between the riser passage and the fill pipe to an upper open position to permit the molten metal to flow thereby to the riser passage and mold cavity as the molten metal is urged upwardly through the fill pipe, (d) applying a magnetic force to the open valve means to move said valve means to a lower closed position where said valve means prevents flow of molten metal from the metal-filled riser passage and mold cavity while permitting the molten metal to drain from the fill pipe, and (e) relatively moving the mold and the pool to remove said fill pipe lower open end from the pool with said valve means being in the closed position.

* * * * *

UNITED STATES PATENT AND TRADEMARK OFFICE

CERTIFICATE OF CORRECTION

PATENT NO. : 4,961,455

DATED : October 9, 1990

INVENTOR(S) : John A. Redemske, et al

It is certified that error appears in the above-indentified patent and that said Letters Patent is hereby corrected as shown below:

Title page, item [54], and column 1, line 1,

Delete "Casing" and insert therefor --CASTING--.

COl. 6, line 2, delete "sectional".
line 38, delete "b" and insert --be-- therefor.

COL. 8, line 13, after "wherein" insert --in--.

Signed and Sealed this

Twenty-second Day of June, 1993

*Attest:*

Michael K. Kirk

MICHAEL K. KIRK

*Attesting Officer*

*Acting Commissioner of Patents and Trademarks*